United States Patent [19]

Nesti

[11] 4,173,289

[45] Nov. 6, 1979

[54] STEEL WIRE STACKABLE UPSETTABLE-WALL CONTAINER

[75] Inventor: Gian P. Nesti, Como, Italy

[73] Assignee: Campisusa S.P.A., Milan, Italy

[21] Appl. No.: 931,165

[22] Filed: Aug. 4, 1978

[30] Foreign Application Priority Data

Sep. 14, 1977 [IT] Italy ..... 22211 B/77

[51] Int. Cl.[2] ..... B65D 7/24; B65D 7/20; B65D 7/00; B65J 1/02

[52] U.S. Cl. ..... 220/7; 220/1.5; 220/19; 220/4 F

[58] Field of Search ..... 220/4 F, 6, 19, 7, 1.5, 220/4 R; 292/302, 183, 189

[56] References Cited

U.S. PATENT DOCUMENTS

| | | | |
|---|---|---|---|
| 2,681,744 | 6/1954 | Averill | 220/7 |
| 3,861,554 | 1/1975 | Legg et al. | 220/1.5 X |
| 3,888,379 | 6/1975 | Folberth | 220/1.5 X |
| 4,023,698 | 5/1977 | Joseph | 220/19 X |

*Primary Examiner*—Steven M. Pollard
*Attorney, Agent, or Firm*—Bucknam and Archer

[57] ABSTRACT

A steel wire stackable upsettable-wall container is described which comprises a base plane, preferably of rectangular shape, and four upsettable reticular structures, made of steel wire and acting as side walls, rear wall and front wall. The front wall is laterally provided with two vertically movable plates which, as the container is assembled, are raised and engage hook elements located at the sides of the reticular structures. The edges of the three sides of each plate are bent or folded back and engage the steel wires of the front wall reticular structure. Each hook element is inwardly bent and has the upper corner rounded in such a way as to act as a slanted plane for the corresponding plate.

5 Claims, 3 Drawing Figures

STEEL WIRE STACKABLE UPSETTABLE-WALL CONTAINER

The present invention relates to a steel wire stackable upsettable-wall container.

As it is known, the collapsible containers are normally provided with wall locking systems requiring the operation of handles, hooks and the like.

It is also known that the folding steps of the conventional steel wire upsettable wall containers always provide for the upsetting of the front wall onto the yet folded or collapsed other walls.

Accordingly, the mounting or assembling of said containers may cause difficulties to arise, due to the need of maintaining vertically oriented the walls while operating handles or locking hooks.

Therefore it is an object of the present invention to provide a steel wire upsettable-wall container which does not present the aforesaid assembling drawback.

According to the present invention, the aforesaid and other objects are achieved by a steel wire stackable container comprising a base plane, preferably of rectangular shape, provided, at each side thereof, with an upsettable wall, wherein the front wall, joint-connected on one of the main sides of the base plane, is laterally provided with two movable plates which, as the container is assembled, are moved and engaged with corresponding hook elements located at the sides of the reticular structures joint-connected at each side of the base plane.

In particular, the plates are movably fixed to the wires located at the front wall sides and are able to translate only in a vertical direction. The hook elements are inwardly curved and have an upper rounded corner thereby engaging with and acting as a slanted plane for the corresponding plate which, as the container is assembled, is firstly upwardly moved from the slanted plane and then, after the passing of the hooking element, drops to the starting position thereby locking said hooking element.

In this manner, as the container is assembled, the front wall automatically engages the in advance raised side walls thereby providing the locking of said walls.

The base plane is preferably mounted of four feet located at said corners thereby allowing for a plurality of containers to be stacked onto one another.

Figure 1:
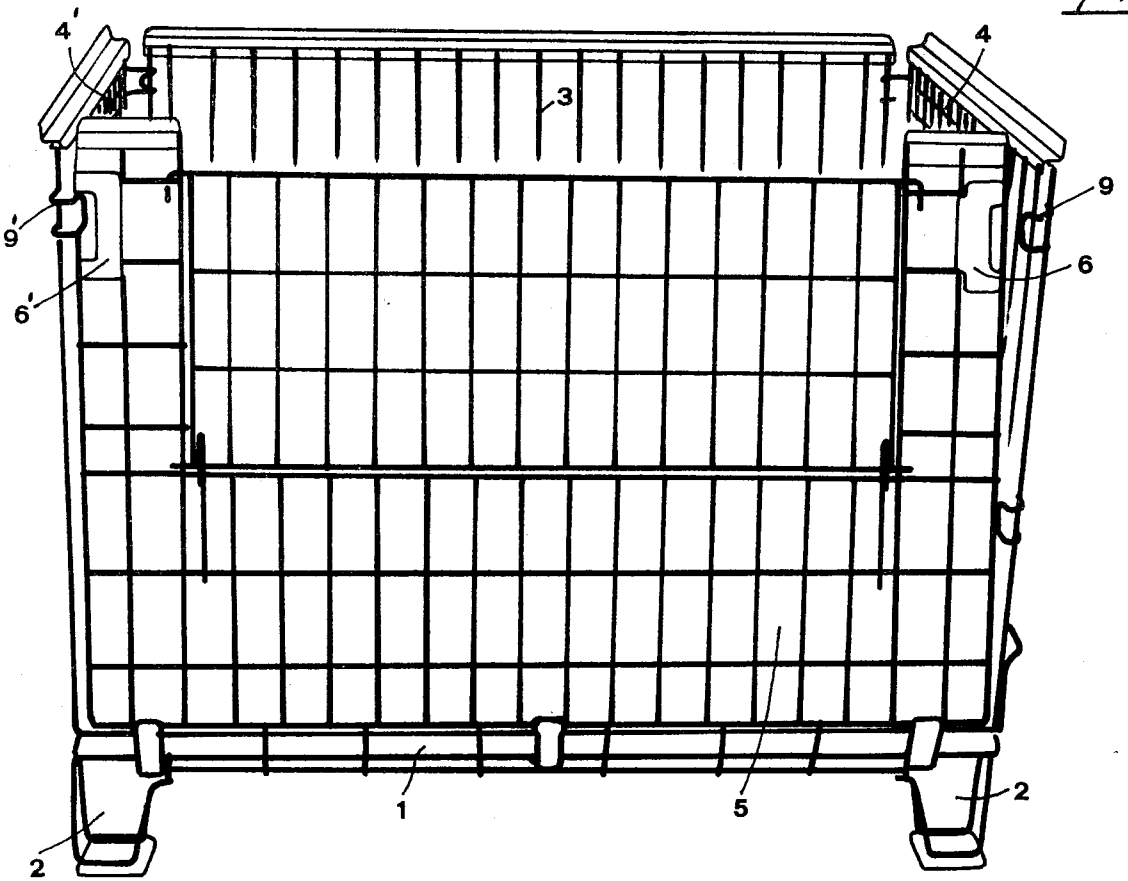
Figure 3:
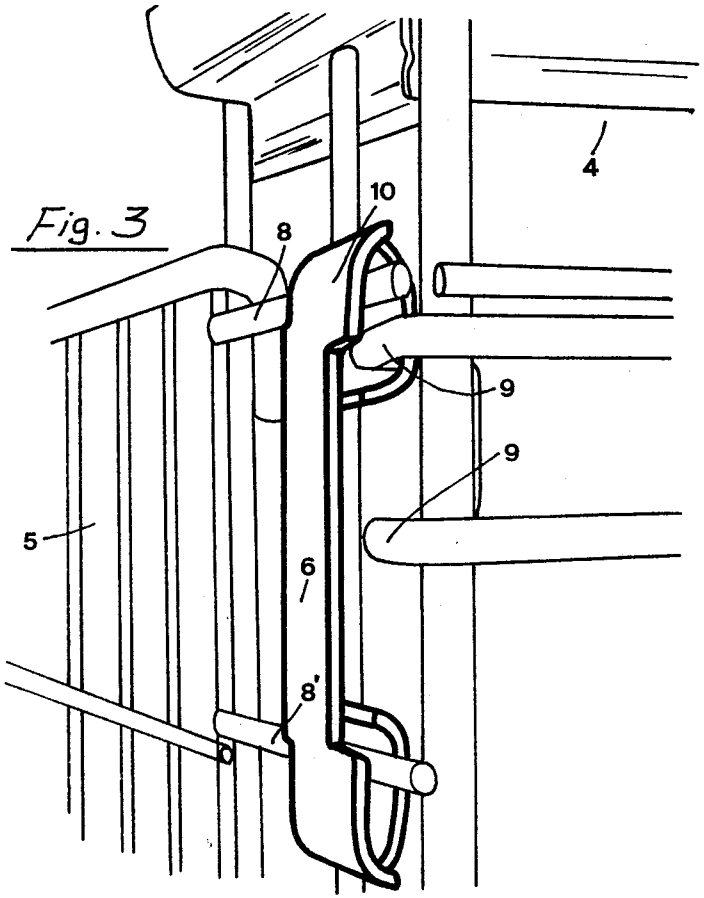
Figure 2:
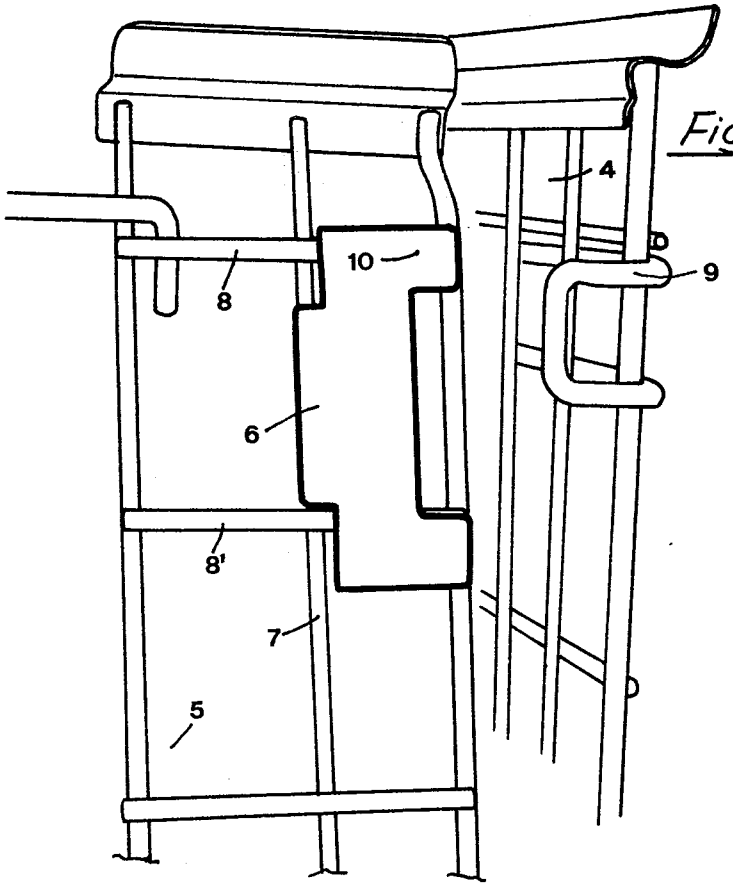

In order to better understand the functional and constructional characteristics of the instant steel wire upsettable wall container, this latter will be thereinbelow described with reference to the figures of the accompanying drawings illustrating an exemplificative and not limitative preferred embodiment of the present invention, where:

FIG. 1 is a perspective view of the instant container and shows the upwardly upsetting step of the front wall; and FIG. 2 and 3 illustrate the locking system between the front wall and the two side walls.

Referring particularly to the figures, the instant steel wire upsettable-walls container comprises a base rectangular plane (1) provided, at the four corners thereof, with corresponding feet (2).

To one of the main sides of the base plane (1) a steel wire structure (3) is joint-connected, said structure acting as the rear wall of the container.

Two further structures (4) and (4') of substantially reticular shape, forming the side walls of the container, are hooked by means of hook elements to the side edges of the rear wall (3).

To the other main side of the base plane (1) a fourth steel wire structure (5) is joint-connected acting as the front wall of the container.

At the upper portion of the front structure (5), and at a lateral position, two plates (6) and (6') are applied the edges whereof, at three sides, are so folded back as to engage the steel wires forming the structure.

In particular the edges of the plates (6) and (6') are laterally connected to the wire (7) and swingably connected to the parallel horizontal wires (8) and (8') thereby being able of translating only in a vertical direction.

At the side of each side wall (4) and (4') facing the structure (5) it is located, at a level related to the level of said plates, a respective hook element (9) and (9') inwardly bent and having a rounded upper corner.

Said rounded corner acts, substantially, as a slanted plane for each plate (6) or (6') thereby raising each said plate as the front wall (5) is upwardly upset.

The plates (6) and (6'), after the passing of the rounded corner, drop again downwardly, due to the gravity effect, thereby engaging the upper fin (10) of the plates on the outer face of the related hook elements (9) and (9').

On the other hand the dropping of the front wall (5) is obtained by upwardly pushing the plate (6) and (6') in such a way as to disengage the fin (10) from the holding hook (9) and (9').

From the above description and the examination of the several figures of the accompanying drawings, the functionality and practicity of use characterizing the upsettable wall container according to the present invention are self-evident.

Obviously in the carrying out of the instant steel wire upsettable wall container, several changes and modifications may be brought about within the spirit of the invention and without departing from the scope thereof.

I claim:

1. A steel wire stackable upsettable-wall container comprising a base plane and four upsettable reticular structures, made of steel wires which are joint-connected onto the sides of said base plane, one of said reticular structures acting as the rear wall, the opposite reticular structure acting as the front wall and the other two reticular structures acting as the side walls, hook elements located on said side walls, wherein the front wall is laterally provided with two vertically movable plates, said plates being raised and engaging said hook elements when the container is assembled and wherein the edges of the three sides of each plate are bent or folded back and engage the steel wires of the front wall reticular structure.

2. A stackable container according to claim 1, wherein the upper and lower edges of each plate are swingably connected to two parallel horizontal wires of the front wall reticular structure.

3. A stackable container according to claim 1 wherein each hook element is inwardly bent and has the upper corner thereof rounded in such a way as to act as a slanted plane for the corresponding plate.

4. A stackable container according to claim 1 wherein, in opening conditions, the upper fin of each plate is anchored onto the outer face of the hook element.

5. A stackable container according to claim 1 wherein the side reticular structures located onto each small side of the base plane are hooked to the rear reticular structure by means of hook elements.

* * * * *